US006802669B2

(12) United States Patent
Ianniello et al.

(10) Patent No.: US 6,802,669 B2
(45) Date of Patent: Oct. 12, 2004

(54) VOID-MAINTAINING SYNTHETIC DRAINABLE BASE COURSES AND METHODS FOR EXTENDING THE USEFUL LIFE OF PAVED STRUCTURES

(76) Inventors: Peter J. Ianniello, 2000 Level Rd., Havre de Grace, MD (US) 21078; Giovanni Capra, 2908 Shadow Brook Ct., Ellicott City, MD (US) 21042; Aigen Zhao, 6205 Waving Willow Path, Clarksville, MD (US) 21029

( * ) Notice: Subject to any disclaimer, the term of this patent is extended or adjusted under 35 U.S.C. 154(b) by 0 days.

(21) Appl. No.: 10/232,811

(22) Filed: Sep. 3, 2002

(65) Prior Publication Data

US 2003/0223819 A1 Dec. 4, 2003

Related U.S. Application Data

(63) Continuation-in-part of application No. 09/501,324, filed on Feb. 10, 2000, now Pat. No. 6,505,996, and a continuation-in-part of application No. 09/501,318, filed on Feb. 10, 2000, now abandoned.

(60) Provisional application No. 60/316,036, filed on Aug. 31, 2001.

(51) Int. Cl.[7] ..... E01C 3/06

(52) U.S. Cl. ..... 405/50; 405/302.7; 404/28; 404/31

(58) Field of Search ..... 405/36, 43, 45, 405/46, 50, 52, 270, 302.7; 404/2, 3, 427–31; 210/170, 747; 428/86; 442/383, 388, 36, 57

(56) References Cited

U.S. PATENT DOCUMENTS 4,397,899 A * 8/1983 Marsh et al. ..... 428/77
4,749,306 A * 6/1988 Demeny et al. ..... 405/45
4,815,892 A * 3/1989 Martin ..... 405/45
4,992,003 A * 2/1991 Perach ..... 405/302.7
5,183,355 A * 2/1993 Treat et al. ..... 405/129.85
5,190,406 A * 3/1993 Shannonhouse et al. . 405/129.6
5,735,640 A * 4/1998 Meyer et al. ..... 405/302.7
5,823,706 A * 10/1998 Hoare et al. ..... 404/28
5,980,155 A * 11/1999 Jones et al. ..... 405/43
6,481,934 B1 * 11/2002 Alexiew ..... 405/302.7
6,558,081 B2 * 5/2003 Hull ..... 405/157
6,599,058 B1 * 7/2003 Arnold ..... 405/129.85
6,648,549 B1 * 11/2003 Urriola ..... 405/39
2001/0002497 A1 * 6/2001 Scuero ..... 14/73
2003/0118404 A1 * 6/2003 Lee ..... 405/43
2003/0199217 A1 * 10/2003 Cashin et al. ..... 442/394
2003/0215287 A1 * 11/2003 Prevost ..... 404/71
2003/0223826 A1 * 12/2003 Ianniello ..... 405/302.4
2004/0022583 A1 * 2/2004 Bussey et al. ..... 405/43

FOREIGN PATENT DOCUMENTS

JP 03180611 A * 8/1991 ..... E02B/11/00

* cited by examiner

*Primary Examiner*—Thomas B. Will
*Assistant Examiner*—Alexandra K. Pechhold
(74) *Attorney, Agent, or Firm*—Gary L. Shaffer, Esq.

(57) ABSTRACT

Numerous embodiments of a synthetic drainable base course ("SDBC"), and paved structures that may advantageously include an SDBC, are provided. As a key advantage of SDBC's according to the invention, they are of sufficient capacities and structural strength to be used within layered paved structures such as highways, airport runways and parking lots, to provide drainage superior to that afforded by conventional means and methods involving the use of open graded base courses that are typically formed of natural soils and aggregate and are extremely expensive to install. The invention includes means and methods that use conventional heavy equipment for installing an SDBC during the construction of a roadway or other paved surface.

50 Claims, 5 Drawing Sheets

VOID-MAINTAINING SYNTHETIC DRAINABLE BASE COURSES AND METHODS FOR EXTENDING THE USEFUL LIFE OF PAVED STRUCTURES

RELATED APPLICATIONS

The present application is a Continuation-In-Part of U.S. patent application Ser. No. 09/501,324, filed Feb. 10, 2000 now U.S. Pat. No. 6,505,996, and U.S. patent application Ser. No. 09/501,318, filed Feb. 10, 2000 now abn., and U.S. Provisional Application No. 60/316,036, filed Aug. 31, 2001. The cited Applications are hereby incorporated by reference.

FIELD OF THE INVENTION

The present invention pertains to means and methods for extending the life of paved structures such as highways and airport runways by providing improved and novel drainage systems of geosynthetic elements that can be installed economically with conventional road building and construction equipment.

BACKGROUND OF THE INVENTION

Water is a principal cause of distress and damage to paved structures such as roadways, airport runways and parking lots. Therefore, drainage systems are often provided in such structures in order to remove water from the paved surface or its foundations to thereby extend the useful life of the pavement surface. In some drainage methods, drainage systems are incorporated between the native soils or "subgrade" upon which a roadway or other large structure is situated and the overlying pavement surfaces. The present invention relates generally to synthetic void-maintaining structures with high permittivity and high transmissivity that are capable of extending the life of pavement by maintaining voids of sufficient dimensions to permit the timely egress of undesirable fluids. In conventional roadbuilding, natural stone and aggregate materials are placed to form a drainable layer that is commonly called an Open Graded Base Course, or "OGBC." OGBC's are typically used underneath the surfaces of highways, airport runways, roads, and parking lots that are paved with bituminous materials such as asphalt or cementitious materials such as concrete. The present invention comprises a Synthetic Drainable Base Course ("SDBC") of polymeric material and related methods for constructing paved surfaces such that the need for an OGBC can be eliminated or minimized.

Pavement surfaces are highly engineered layered structures. Because of this, pavement structures require engineered materials that are selected based upon factors such as their density, particle or aggregate size, compressibility or other engineering parameters of the soil, stone and aggregate-based products that are required as structural fill that typically is installed in layers beneath pavement surfaces.

Two types of structural fill are the base course and, typically immediately beneath the base course, a subbase course. Fluids such as water that become trapped or retained within structural fill cause damage to roadways and, over time, subsequently greatly reduce the useful life of a pavement system. These destructive phenomena occur even when asphalt additives, waterproofing techniques and conventional geosynthetics are used to improve the road.

The cause of many premature pavement failures has been traced to inadequate subsurface drainage. Typically, fluids enter the subsurface layers of pavement systems from surface infiltration through joints and cracks in the pavement, as well as pores in the pavement itself, seepage from the sides of the paved surface, and from rising groundwater beneath the road surface, either by capillary action or the upward movement of water in vapor form. In fact, the FHWA discovered that over 50% of all rainfall reaching a mature pavement surface enters underlying structural portions of the pavement through infiltration. In northern tier states, the destructive nature of water trapped in the structural base is exacerbated by freeze-thaw cycles, and particularly during spring thaw as ice lenses melt to create water-filled voids and very soft, water-saturated soils which lose a substantial amount of their compressive strength. In turn, these phenomena result in extensive damage to the highway system. These and related drainage-based structural issues are now well-recognized in the road and runway building industries.

When there is a high fluid content within soil or other layers supporting pavement that carries vehicular traffic, reduced bearing capacity can occur, resulting in deformation of the contour of the road surface, wheel rutting, and premature collapse or failure of the roadway. The American Association for Safety and Highway Transportation Officials (AASHTO) issued design methodologies in 1993 that underscore the observation that damage to roadways occurs when fluid such as water is retained. In promulgating standards for quantifying the drainage performance of highways and other paved surfaces, AASHTO rates pavement drainage performances from "excellent," where water is removed from the roadway system within two hours, to "poor," where water is removed within one month. Drainage coefficients corresponding to these ratings are often used as direct design parameters in highway construction. For example, the drainage coefficient corresponding to an "excellent" drainage system in a roadway section would typically be at least two times greater than the corresponding drainage coefficient for "poor" drainage system in a similar section of roadway. In general, a drainage system having a higher drainage coefficient increases the corresponding effective structural rating of a section of roadway. Therefore, higher drainage coefficients generally correspond to a longer or extended service life, or result in the reduction of the overall structural cross-section, and therefore the amount of engineered materials, necessary to support a particular load.

Other engineering parameters reflect the importance of sufficient drainage to roadways. For example, the presence of water in pavement causes a reduction of the resilient modulus, which reduces the ability of a pavement surface to support traffic loads. In 1993, AASHTO reported that water saturation can reduce the dry modulus of asphalt paving by 30% or more. Moreover, added moisture in unbound aggregate base and subbase layers was estimated to result in a loss of stiffness on the order of 50% or more. With water retention, a modulus reduction of up to 30% can be expected for an asphalt-treated base as well as an increased erosion susceptibility of cement or lime-treated bases. In addition, with inadequate drainage, saturated fine-grain road-bed soil may experience modulus reductions of over 50%. Furthermore, the presence of fluids often causes the buildup of hydraulic pore pressure that, in turn, reduces the effective stress capacity of the soil materials that were placed to support the pavement system.

Premature failure of pavement systems results in unacceptably high life-cycle costs for highways and other large paved structures. One conventional approach to the prevention of such premature failure from occurring has been directed toward developing means and methods for waterproofing roads. After years of expense and effort, however, waterproofing paved surfaces sufficiently to extend their useful life has proven to be quite challenging and somewhat unsuccessful. At the present time, industry focus has shifted from attempts at preventing water from entering the pavement surface to developing ways for removing water from the subbase and other base materials underlying the pavement. This shift in focus has been the subject of a number of publications in the field. One such publication is *Drainage of Highway and Airfield Pavements*, H. R. Cedegren (1987, R.E.K. Publishing Co.). In his book, Cedegren emphasizes that proper base and subbase drainage are considered to be more essential than paved surface waterproofing with respect to assuring that a pavement structure will perform for the duration of its design life. Cedegren projects that pavement useful life can be extended up to three times (e.g., a service life can be extended from 15 years, to 45 years) if adequate subsurface drainage systems are installed and maintained. The benefits of good drainage are also recognized in many current roadway design methodologies published in the early 1990's by AASHTO and the U.S. Army.

Other published studies support this view. In one of them, "*The Economic Impact of Pavement Subsurface Drainage*," R. A. Forsyth (1987, Transportation Research Record 1121, National Research Council, Washington, D.C.), the author reports at least a 33% increase in service life for asphalt pavement and a 50% increase for PCC pavements when subsurface drainage systems are used. Significantly, Forsyth observed a new crack reduction ratio of 2.4:1 when PCC pavements with subsurface drainage systems were compared to those without a subsurface drainage system. Moreover, other studies that reviewed pavements constructed to include base course layers constructed of non-uniform gradation, and consequently non-uniform and insufficient drainage capacity, concluded that service life was actually decreased by 50% when the pavement was saturated for periods as small as 10% of the year, that is, for approximately one month per year.

The economic disadvantages of inadequate subsurface drainage are significant. Indeed, KYDOT concluded that the costs of failing to properly drain a road could be up to $500,000 per mile when the costs of safety and repair delays are considered. KYDOT has also shown that providing a drainage mechanism along the edge of a road can improve road life by 40% when the system is installed properly. Other state agencies support this assessment. For example, the Maine DOT has observed that for an additional 20% increase in initial construction costs, proper drainage can double the expected useful life of a road. Studies by the University of Maine have quantified these observations with respect to actual soil permeability of various road bases throughout Maine. The University of Maine studies concluded that roads constructed with as little as 4% fines within the base and subbase courses drained at very slow rates, only two feet per day. This means that if a road, such as one observed in the study, had water traveling a typical distance of 20 feet, that is, 2 feet downwardly and 18 feet horizontally to a ditch or drain at the road's edge, it would take ten days for the road to drain, even if no additional fluids entered that same section of the road.

Thus, the rate at which water and other fluids are transported away from the various layers or levels of a paved surface is a critical element in its useful life. As can be easily seen, premature pavement failure due to inadequate drainage is an extremely serious and costly problem affecting the transportation infrastructure of North America and other areas. Indeed, Cedergren reported that 212 billion dollars U.S. was spent in 1991 on repairing highway deficiencies that were largely a result of poor drainage.

In one conventional method of approaching these drainage problems, an Open Graded Base Course, or "OGBC," drainable layer formed of natural stone and aggregate materials is included beneath a roadway or other paved structure in an attempt to positively control fluids and dissipate pore pressures which commonly accumulate under large pavement structures. Typically, an OGBC-drainable pavement includes a layer of asphalt or concrete surface pavement, a permeable base, a separate filter layer, the subgrade, and an edge drain as shown in FIG. 2. In theory, an OGBC drainable pavement provides a fluid-permeable zone beneath the pavement surface in order to alleviate the hydraulic problems attendant to poor drainage. On the other hand, the optimal performance of a pavement system is achieved by preventing water from entering the pavement and removing any water that does enter by means of a well-designed subsurface drainage system.

An OGBC is intended to be a porous drainage media that is capable of receiving fluids from the points of entry and then transporting them to designated discharge points in a timely manner. According to the FHWA, an OGBC permeable base such as that shown in FIG. 2 is estimated to have a minimum permeability of 1,000 lineal feet per day. A permeability in this range will allow for drainage of the overlying pavement to occur within a few hours and thus would be considered as "excellent drainage" as defined by AASHTO. Because OGBC is installed as a highly porous and permeable system underneath an entire pavement section, it affords drainage to fluids regardless of their points of entry. For these reasons, OGBC has been viewed in the field as having acceptable parameters of fluid interception and drainage with respect to pavement systems.

OGBC is typically produced from stone that has been mined from quarries. A main distinguishing characteristic of OGBC materials is that they are usually delivered to work sites having a fairly uniform gradation per the specifications of the project engineer. Typically, project engineers use published standards for OGBC available from AASHTO, the Federal Highway Administration, or their resident state's department of transportation. Theoretically, uniform gradation of OGBC materials typically creates voids of desired and predictable dimension between them when they are in place. Thus, desired flow rates through both vertical and horizontal planes of the OGBC can be increased or decreased somewhat predictably by selecting appropriate size distributions of the particulate material.

Nonetheless, there are many disadvantages in OGBC drainage systems that appear to be caused by the lack of mechanical and dimensional stability provided by using uniform size gradations of stone. Although such gradations create interconnecting void spaces or holes with the aggregate for the purpose of receiving and transmitting fluid, OGBC by its very nature is susceptible to unacceptable amounts of lateral movement when exposed to shear stresses caused by typical traffic loading. This condition necessitates the need to chemically bond OGBC particulate materials to one another with cementitious or bituminous materials. The use of such bonding materials serves not only to increase costs, but to actually reduce the volume and extent of void space that remains within the OGBC. Thus, by addressing the problem of lateral stress, the void space required for sufficient drainage is reduced to unacceptable levels. Other disadvantages pertain to the additional elements that are required in an OGBC installation. Typically, a well graded granular or geotextile filter layer is needed above the OGBC in order to prevent contamination of the OGBC from the migration of subgrade fines. This extra filter layer further increases the costs of the roadway construction.

Although an OGBC's interconnected void spaces may afford an acceptable level of drainage for some applications, the use of an OGBC conflicts with many established road pavement design practices. This is the case because roadways designed for long-term use often require the elimination of void spaces in order to obtain strength, reduce the movement of particles, sand and aggregate, and thereby increase the load-carrying capacity of the paved surface. Furthermore, unacceptably high construction costs are sometimes incurred when using an OGBC because of the need for precision and extensive on-site quality control in order to increase the chances that a high-flow OGBC system will last for the life of the overlying paved surface.

Another particular problem with the use OGBC's for drainage relates to their long-term performance. It is not uncommon to find distress in some OGBC systems after only a few years of apparently satisfactory service. Initial indications are that the drainage from the system has slowed and that the pavement and one or more base layers are moving with respect to one another, resulting in loss of sufficient support to overlying pavement layers. Some researchers and practitioners have suggested that the failure of an open-graded base course as a drainage layer is far more detrimental to the stability of a paved surface then the presence of a fluid-saturated dense-graded base course. For this and related reasons, current concerns now focus on the long-term stability and hydraulic conductivity of the open-graded bases and their effect on pavement performance.

The hydraulic conductivity of OGBC's over time is susceptible to the deleterious clogging effects of the upward migration of subgrade soil particles into the layer, as well as from the infiltration of fine particles from fractures in the pavement surface. While there is still a need to determine the optimum balance between stability and hydraulic conductivity for the least cost, equally important is the need to identify construction methods and materials for maintaining the initial stability and hydraulic characteristics of an OGBC over time.

Yet another problem with the OGBC is that quality aggregate is not always available or, if available, at uneconomically or prohibitively high costs. There is therefore a need for a drainage system that utilizes components which can be engineered and manufactured offsite to provide equivalent or superior flow to OGBC's and that can be integrated economically within a large paved structure to provide efficient and cost effective drainage for the structure, while also providing sufficient dimensional, mechanical and hydraulic capability.

In general, geosynthetics are manufactured from polymeric materials, typically by extrusion, as substantially planar, sheet-like, or cuspidated products. Geosynthetics are usually made in large scale, e.g., several meters in width and many meters in length, so that they are easily adaptable to large-scale construction and landscaping uses. Many geosynthetics are formed to initially have a substantially planar configuration. Some geosynthetics, even though they are initially planar, are flexible or fabric-like and therefore conform easily to uneven or rolling surfaces. Some geosynthetics are manufactured to be less flexible, but to possess great tensile strength and resistance to stretching or great resistance to compression. Certain types of geosynthetic materials are used to reinforce large manmade structures, particularly those made of earthen materials such as gravel, sand and soil. In such uses, one purpose of using the geosynthetic is that of holding the earthen components together by providing a latticework or meshwork whose elements have a high resistance to stretching. By positioning a particular geosynthetic integral to gravel, sand and soil, that is with the gravel, sand and soil resident within the interstices of the geosynthetic, unwanted movement of the earthen components is minimized or eliminated.

Most geosynthetic materials, whether of the latticework type or of the fabric type, allow water to pass through them to some extent and thus into or through the material within which the geosynthetic is integrally positioned. Thus, geosynthetic materials and related geotechnical engineering materials are used as integral part of manmade structures or systems in order to stabilize their salient dimensions.

Before the present invention, the only geosynthetic materials available for pavement drainage were exclusively limited to drain at the edge or shoulder of a roadway. These edge-drain systems are commonly located within a covered trench originally dug along the shoulder of the roadway. Conventional edge drain geosynthetics, however, cannot withstand the repeated dynamic loads that are present directly beneath pavement surfaces.

Until the present invention, no geosynthetic material had been designed or implemented that could provide a drainage system of equivalent or superior drainage to those of an OGBC as it is used in an entire roadway or an entire roadway portion. Similarly, until the present invention, no geosynthetic material had ever been designed that could maintain voids of defined and sufficient dimensions while undergoing the repeated dynamic cycles of traffic-loading conditions and thereby effectively inhibit the destructive vertical fluid migration within the structural fill underneath a pavement surface. Until the present invention, practitioners skilled in the art of using geosynthetics in road design were still required to consider the maximum distance to drain, for each quantity of fluid to be drained, to be the distance from the center of the road to the perimeter of the paved surface in contact with soil.

The present SDBC void-maintaining system is the first such synthetic material that allows those skilled in the art of pavement design to reduce the distance to drain. The maximum distance to drain for an SDBC system is the vertical distance between the fluid entry point to water contact with the SDBC. Water migrates and enters the SDBC system and then travels through the SDBC where the fluid is then discharged in a timely manner in designated areas along the perimeter of the road. The present invention thus offers a synthetic product that overcomes the many deficiencies of the OGBC to those skilled in the art of pavement design.

The present invention relates generally to synthetic void-maintaining structures with high permittivity and high transmissivity that are capable of extending the life of pavement by removing undesirable fluids. The present invention, Synthetic Drainable Base Course (SDBC), overcomes stability and soil particle migration concerns associated with OGBC because the present invention, SDBC, possesses desirable properties that make it capable of being a suitable replacement for OGBC to those skilled in the art of pavement design.

The preferred embodiment of the present SDBC invention overcomes the previously mentioned disadvantages by providing plurality of interconnected voids of great mechanical and dimensional stability while simultaneously providing sufficient horizontal flow to perform in accordance with "Good to Excellent" drainage when assessed with AASHTO definitions. These performance attributes are unique to SDBC. SDBC systems eliminate many of the problems associated with fluids underlying large structures that are not resolved by conventional OGBC systems or any geosynthetic product. By eliminating these problems, SDBC extends the useful life of the overlying structure.

In accordance with other aspects of the present invention, the SDBC can be positioned in a roadway to maximize their effectiveness. For example, SDBC can be positioned directly beneath the pavement surface, immediately beneath the base Course, or directly above a subgrade if a subbase is not present.

An SDBC of the invention can be made in large pieces. For example, in pieces several meters wide and many meters long. For convenience and installation, however, an SDBC and its components may be installed in portions which are interconnected such that the interconnecting voids are of sufficient dimension that the water from the roadway can move freely through the SDBC and can be connected to drain means such as a perforated pipe, ditch, or culvert adjacent to the pavement structure.

In one aspect of SDBCs of the invention, the preferred void dimensions are maintained under load. For example, typically the lower surface of the super stratum, that is, the upper fluid-transmissible layer, and the upper surface of the substratum, that is, the lower fluid-transmissible layer, are prevented from having contact with one another when the upper surface of the substratum and the lower surface of the super stratum are placed under sustained loads above 1,000 psf and the lower surface of the substratum and upper surface of the super stratum are in contact with a soil environment for a duration of not less than 100 hours.

Other advantages of the present SDBCs can be seen with respect to their fluid transmitting capacity. For example, in some embodiments, an SDBC of the present invention typically exhibits a fluid transmitting capacity of at least 2,000 ft.$^3$/day/ when tested utilizing ASTM D 4716. Thus, the present SDBCs exhibit superior fluid transmitting characteristics and meet the specifications for classification as "Excellent to Good" under AASHTO's definitions.

An SDBC, according to the present invention, is superior to conventional drainage elements, inter alia, because it is capable of resisting dynamic traffic stress to the extent that it resists creep deformation and structural catastrophic collapse under load by retaining 60% of its external dimensional thickness after 10,000 hours under a sustained normal load of 1,000 pounds per square foot. In some preferred embodiments, an SDBC of the invention has a plurality of relatively parallel-interconnected voids that create preferential flow paths perpendicular to the direction, or central line, of a road or highway in which they are placed. Preferably, an SDBC, according to the invention, comprises an upper fluid-transmissible surface and a lower fluid transmissible surface, and the core is pervious to the vertical migration of fluids. Furthermore SDBCs are preferably constructed and arranged to transmit fluids to discharge points, either under the roadway or at its edge, that utilize perforated piping or other collection means, whereby the piping or other collection means is designed to receive fluids transported from beneath the road surface by means of the SDBC.

SDBCs of the present invention can be fabricated into panels of various lengths and widths by using a means to weld, tie or sew SDBC sections to one another to form a continuous SDBC underneath construction soils and pavement. Typically, an SDBC of the present invention is positioned so that it is installed beneath pavement and above the natural soil native to the construction site. Also typically, the present SDBCs reduce the distance to drain from the horizontal plane governed by the slope to the vertical distance between the SDBC and the fluid entry point.

SUMMARY OF THE INVENTION

It is therefore an object of the present invention to provide economical means and methods for providing drainage to roads, highways and other large paved structures.

It is also an object of the invention to provide synthetic drainable base courses that may be used in place of open graded base courses in highways and other large paved structures.

It is a further object of the invention to provide synthetic drainable base courses that may be positioned in highways and other large paved structures with the use of conventional road-building equipment.

In accordance with these and other objects of the invention, a synthetic drainable base course for draining fluids away from a roadway or other large structure is provided. In one preferred embodiment, an SDBC of the invention comprises a void-maintaining geocomposite, including i) a geocomposite core element having a plurality of ribs constructed and arranged to form a plurality of interconnected voids, the core element having an upper surface and a lower surface, a no-load thickness and a thickness under load, wherein the thicknesses are measured substantially perpendicular to the surfaces, ii) at least one fluid-transmissible layer adjacent the upper surface, and iii) at least one fluid-transmissible layer adjacent the lower surface of the geocomposite.

Advantageously, SDBC's of the invention are constructed to withstand higher than typical traffic loads when used in a paved strauctre. For example, in some embodiments, the layers and the core are constructed and arranged so that, under a load of at least 750 lbs/foot$^2$ for a period of at least 100 hours, the geocomposite maintains voids of sufficient dimension that fluid from the roadway or other large structure can move freely through the geocomposite at rate of at least 1,000 feet$^3$/day/foot. Typically, the SDBC is sloped downwardly in a gradient from a portion of the roadway, such as its centerline or from a margin such as the side of a banked highway, or from a centerline or other portion or axis of another paved structure. In other preferred embodiments, the layers and core of the SDBC are constructed and arranged so that, under a load of at least 1,000 lbs/foot$^2$ for a period of at least 100 hours, the void-maintaining geocomposite maintains voids of sufficient dimension that fluid from the roadway or other large structure can move freely through the geocomposite at rate of at least 2,000 feet$^3$/day/foot.

These performance parameters are obtained at least partly because of the structural relationships between and among the rib elements of the core and the fluid-transmissible layers adjacent the core. Preferably, the ribs of the core are made by the extrusion of polymers into adjacent and connected sets such that, when a portion of an SDBC is laid out on a flat surface, each set of ribs lies approximately, or substantially, in a plane adjacent to the planes of one or more adjacent sets of ribs. Thus, in embodiments having two sets of ribs, the ribs of the core are provided in a first set and a second set, with the ribs of the first set disposed substantially parallel to one another and substantially in a first plane, and the ribs of the second set being disposed substantially parallel to one another and substantially in a second plane adjacent to the first plane. The present invention is not limited to biplanar ribbed cores. In other embodiments, further ribs are provided in at least a third set where the ribs of the third set are disposed substantially parallel to one another and in a third plane adjacent and non-parallel to the ribs of the first or second sets.

Although ribs having any shape in cross-section that produce an SDBC of sufficient capacities are suitable for practicing the invention, non-circular ribs are preferred because of the stabilities they afford under shear, for example, and the increase in rib-to-rib contact area they provide. Preferable cross-sectional shapes therefore include those that are, or approximate, squares, rectangles, hexagons and trapezoids. In accordance with other advantageous aspects of the invention, a geocomposite core may comprise ribs of different cross-sectional shapes and dimensions, or all of substantially the same shapes and dimensions.

Dimensions of the rib elements of the invention are selected based upon the engineering and longevity parameters of the environment in which the SDBC will be used. In general, SDBC's destined for use under higher load conditions will tend to have ribs of greater cross-sectional dimensions than those that will be used in lighter traffic environments. For example, when ribs of square cross-section are used, the square has a width and a height approximately equal to one another, and the width and height have dimensions preferable in the range of from 1.0 to 10.0 millimeters ("mm"). With ribs of rectangular cross-section, the rectangle has a width dimension and a height dimension, the width being preferably in the range of from 2.0 to 15.0 mm and the height having dimensions of from 1.0 to 10.0 mm. With ribs of trapezoidal cross-section, the trapezoid has a major width, a minor width and a height, and the major width has dimensions preferably in the range of from 2.0 to 15.0 mm, the minor width has dimensions of from 1.0 to 10.0 mm and the height has dimensions of from 1.0 to 10.0 mm. With rectangular or trapezoidal ribs, the longest dimensions of the respective sets of ribs are substantially parallel to the plane in which they reside.

In accordance with other aspects of the invention, at least some of the ribs have surfaces that are scalloped or crenulated and the crenulations are disposed longitudinally along the surfaces of the ribs. In other embodiments, all of the ribs are crenulated and the crenulations are disposed longitudinally along the surfaces of the ribs. One advantage of crenulations appears to be that they increase resistance to sideways movement and shear.

Significant aspects of SDBC's of the invention pertain to their dimensional stabilities and capacities under load. One way of evaluating dimensional stability pertains to the relative amount of thickness that is retained by an SDBC according to the invention after it is placed under a known load for a known period of time. Another way is that of measuring the flow capacity of an SDBC after it has been under a known load for a known period of time.

SDBC's according to the invention can be made in any thickness so long as the product meets the desired load-carrying and drainage capacities. Nonetheless, in typical road-building and other uses, the no-load thickness of SDBC's according to the present invention preferably is in the range of from 0.20 inches to 1.25 inches, more preferably in the range of from 0.20 inches to 0.75 inches or in the range of from 0.25 inches to 0.35 inches. The proportionate thickness under load of a particular SDBC is one parameter that is indicative of its performance. For example, in SDBC's of the present invention that are destined for use in severe or high-traffic conditions, such as under a load of 1,200 kPa (25,000 lbs/ft$^2$) for at least 10,000 hours, superior performances are achieved with respect to the proportion of SDBC no-load thickness that is maintained. These proportions range from at least 40% to at least 65% of the no-load thickness. Thus, in some embodimenst of the present SDBC's under a load of 1,200 kPa for at least 10,000 hours, the thickness under load is at least 65% of the no-load thickness while in other embodiments the thickness under load is at least 60% of the no-load thickness. In yet further embodiments, the thickness under load is at least 40% or 50% of the no-load thickness.

In embodiments of the invention that are produced for use in less severe conditions, for example under a load of 721 kPa (15,000 lbs/ft$^2$) for at least 100 hours, the present SDBC's are constructed and arranged to maintain a relative thickness under load to be within the range of from at least 40% to at least 65%. Preferably, under a load of 721 kPa for at least 100 hours, the thickness under load is at least 40% of the no-load thickness, more preferably at least 50%, even more preferably at least 60% and most preferably at least 65% of the no-load thickness.

The tensile strength of core elements of SDBC's according to the invention preferably are at least 300 lbs/ft$^2$ in both machine direction and cross-machine direction, more preferably at least 400 lbs/ft$^2$ and most preferably at least 500 lbs/ft$^2$ in both machine direction and cross-machine direction. Preferably, a synthetic drainable base course according to the invention is installed so that a gradient of at least 2% is present in a direction away from a portion of the roadway such as the centerline.

Another parameter for measuring the capacities and performance of the present SDBC's pertains to the size of voids that are maintained under a particular load for a particular period of time. The width and height of such voids can be considered together or as independent dimensions to be measured. For example, embodiments of the invention suitable for less than severe conditions, that is, under a load of 721 kPa for at least 100 hours, include those that maintain voids having an average width in the range of from 2.0 mm to at least 10.0 mm, or from 2.0 to 8.00 mm, or from 3.0 to 6.0 mm. Under similar loads of 721 kPa for at least 100 hours, the voids maintain average height dimensions in the range of from 2.0 mm to 10.0 mm, and preferably in the average height range of from 3.0 mm to 8.0 mm or in the range of from 3.0 mm to 6.0 mm. Similar void-maintaining characteristics pertain to embodiments of the invention constructed and arranged to withstand the more severe conditions of loads of 1,200 kPa for at least 100 hours, and up to at least 1,000 hours.

The width and height of such voids can be considered together in providing SDBC,s of desired dimension and capacities. For example, the present invention includes embodiments suitable for withstanding loads of either 721 kPa or 1,200 kPa for at least 100 hours, or even 1,000 hours, while maintaining voids having an average width in the range of from 2.0 mm to at least 10.0 mm, and an average height of from 3.0 to 10.0 mm. Specific examples include SDBC's placed under a load of 721 kPa or 1,200 kPA for at least 100 hours that maintain an average width of at least 2.0 mm and an average height of at least 8.0 mm, those that maintain an average width of at least 6.0 mm and an average height of at least 8.0 mm, and those that maintain an average width of at least 6.0 mm and an average height of at least 4.0 mm. Similar capacities are achievable with embodiments under such loads for at least 1,000 hours. As one of skill in the art will comprehend, numerous permutations and capacities are within the scope of the present invention.

Advantageously, the ribs of the present synthetic drainable base courses are constructed and arranged to form preferential flow paths and non-preferential flow paths. Preferably, the preferential flow paths and the non-preferential flow paths are not parallel to one another. Flow paths of the invention are formed by the relative placement of the rib elements and are advantageous in that they direct the flow of water or other fluids in a preferred direction. In some embodiments of SDBC's of the invention, they are disposed in a roadway such that the preferential flow path is substantially perpendicular to a portion of the roadway such as the centerline. In such a configuration, the shortest flow path distance between the centerline and a margin of the roadway is achieved.

Preferably, the proportion of fluid that follows preferential pathways is at least 65% of the volume of fluid moving through any given portion of the SDBC. In some embodiments, the core of an SDBC of the present invention includes at least one margin constructed and arranged to transmit fluids from the base course away from the roadway or other large structure. The margin can be at the side of the roadway, and preferably is constructed and arranged to connect with other means for carrying the drained fluid away such as perforated pipes, non-perforated pipes, drainage ditches, sumps, canals, streams and rivers.

A specific example of such an embodiment includes wherein the drain means comprises perforated piping adjacent the synthetic drainable base course and communicating therewith such that the fluid can move from the base course to the perforated piping, wherein the perforated piping is sloped downwardly from the base course, and the base course is constructed and arranged to form a wrapping adjacent to and around the circumference of at least a portion of the perforated piping such that a portion of one of the upper or lower fluid-transmissible geotextile layers is removed along the length of the wrapping so that the geocomposite core contacts the piping and the removed portion of the one of the upper or lower fluid-transmissible geotextile layers comprises overlapping portions and is connected to the other surface fluid-transmissible geotextile layer.

The present invention also comprehends an SDBC as an integral component of layered paved structures such as highways or runways. Such structures comprise a base layer formed at least partially of native soil components, a synthetic drainable base course disposed above the base layer and comprising a void-maintaining geocomposite including i) a geocomposite core element having a plurality of ribs constructed and arranged to form a plurality of interconnected voids, the core element having an upper surface and a lower surface, a no-load thickness and a thickness under load, wherein the thicknesses are measured substantially perpendicular to the surfaces, ii) at least one fluid-transmissible layer attached adjacent the upper surface, and iii) at least one fluid-transmissible layer attached adjacent the lower surface of the geocomposite, wherein the layers and the core are constructed and arranged so that, under a load of at least 750 lbs/foot$^2$ for a period of at least 100 hours, the geocomposite maintains voids of sufficient dimension that fluid from the roadway or other large structure can move freely through the geocomposite at rate of at least 1,000 feet$^3$/day/foot, and, above the synthetic drainable base course, pavement comprising one or more layers of asphalt or cementitious materials, wherein the synthetic drainable base course is sloped downwardly in a gradient from a portion of the roadway or other large structure.

The layered paved structure of the invention may further include a support layer disposed above the synthetic drainable base course, and below the pavement. The support layer may comprise any suitable material or materials such as one or more of native soil components, and non-native soil components, such as stone aggregate, soils, sand or combinations thereof.

Although the present SDBC's can be used in conjunction with conventional open-graded base courses, or attenuated open-graded base courses such as those of reduced thickness, the present SDBC's are advantageously suited to methods for constructing layered paved structures without the necessity of an OGBC. Therefore, the invention includes methods for using any of the elements described herein such as a method of forming a layered paved structure having no open graded base course, comprising the steps of providing comprise a base layer formed at least partially of native soil components, a synthetic drainable base course disposed above the base layer, the SDBC comprising a void-maintaining geocomposite, the geocomposite including i) a geocomposite core element having a plurality of ribs constructed and arranged to form a plurality of interconnected voids, the core element having an upper surface and a lower surface, a no-load thickness and a thickness under load, wherein the thicknesses are measured substantially perpendicular to the surfaces, ii) at least one fluid-transmissible layer attached adjacent the upper surface, and iii) at least one fluid-transmissible layer attached adjacent the lower surface of the geocomposite, wherein the layers and the core are constructed and arranged so that, under a load of at least 750 lbs/foot$^2$ for a period of at least 100 hours, the geocomposite maintains voids of sufficient dimension that fluid from the roadway or other large structure can move freely through the geocomposite at rate of at least 1,000 feet$^3$/day/foot, and, above the synthetic drainable base course, pavement comprising one or more layers of asphalt or cementitious materials, wherein the synthetic drainable base course is sloped downwardly in a gradient from a portion of the roadway or other large structure.

The present methods for forming a layered paved structure may further include providing a support layer disposed above the synthetic drainable base course, and below the pavement. The support layer may comprise any suitable material or materials such as one or more of native soil components, and non-native soil components, such as stone aggregate, soils, sand or combinations thereof.

BRIEF DESCRIPTION OF THE FIGURES

FIG. 5(*b*) shows a detail of the installation of FIG. 5(*a*) where portions of the fluid-transmissible layers of the SDBC are wrapped around the drainpipes.

DETAILED DESCRIPTION OF TYPICAL EMBODIMENTS OF THE INVENTION

The present invention may be understood with respect to the following figures which are exemplary and nit exclusive.

As one of skill in the art will appreciate, numerous embodiments of the invention are within the spirit and scope of the present disclosure.

Figure 1A:
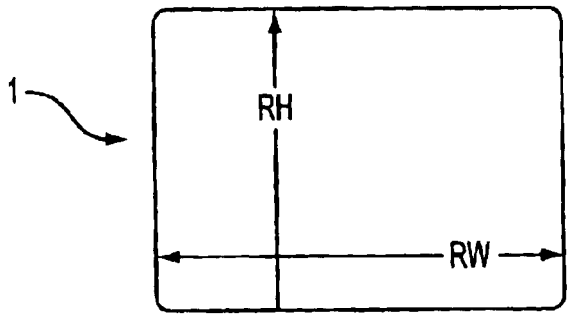
FIGS. 1(*a*), 1(*b*) and 1(*c*) show idealized cross-sectional views of rectangular, trapezoidal and square embodiments, respectively, of polymer ribs of core elements of the invention.
Figure 1B:
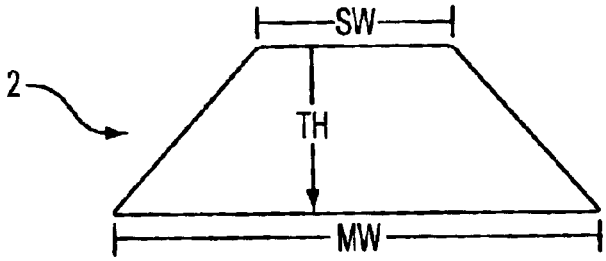
Figure 1C:
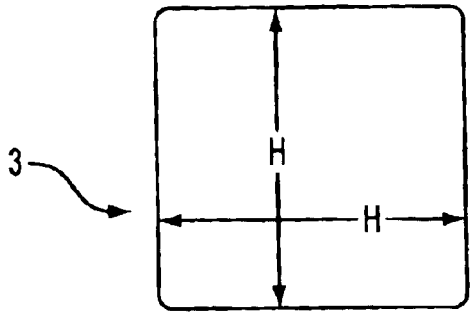

FIGS. 1(*a*), 1(*b*) and 1(*c*) show idealized cross-sectional views of rectangular, trapezoidal and square embodiments, respectively, of polymer ribs of core elements of the invention. With reference to FIG. 1(*a*), rectangular rib 1 has width RW and height RH. With reference to FIG. 1(*b*), trapezoidal rib 2 has trapezoidal major width MW, trapezoidal minor width SW and height TH. With reference to FIG. 1(*c*), square rib 3 has square height and width H. Although core element ribs of these idealized cross-sectional shapes can be used to practice the invention, ribs having uneven, scalloped or crenulated surfaces confer advantages upon SDBC's having them.

Figure 2A:
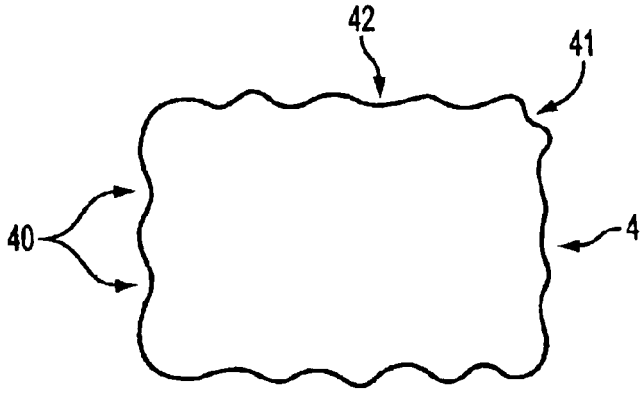
FIGS. 2(*a*), 2(*b*) and 2(*c*) show cross-sectional views of crenulated rectangular, crenulated trapezoidal and crenulated square embodiments, respectively, of polymer ribs of core elements of the invention.
Figure 2B:
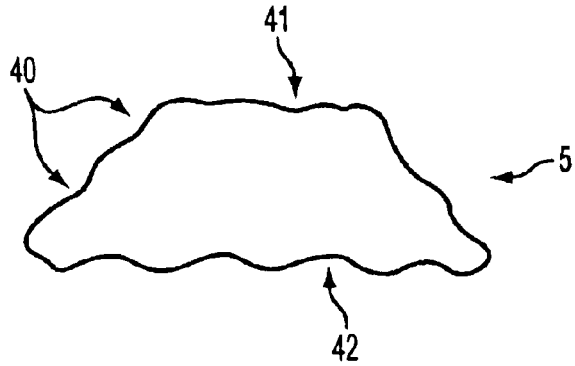
Figure 2C:
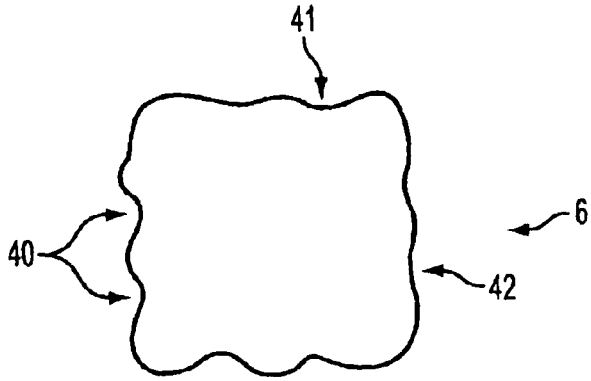

FIGS. 2(*a*), 2(*b*) and 2(*c*) show cross-sectional views of crenulated rectangular, crenulated trapezoidal and crenulated square embodiments, respectively, of polymer ribs of core elements of some embodiments of the invention. FIG. 2(*a*) shows crenulated rectangular rib 4, having dimensions RW and RH that approximate those of rectangular rib 1 shown in FIG. 1(*a*). Crenulated rib 4 has crenulations 40, 41 and 42 disposed longitudinally, that is, parallel to the long axis (not shown) of rib 4. FIG. 2(*b*) shows trapezoidal rib 5 having dimensions SW, TH and MW that approximate those of trapezoidal rib 2 shown in FIG. 1(*b*). Crenulated rib 5 has crenulations 40, 41 and 42 disposed longitudinally, that is, parallel to the long axis (not shown) of rib 5. FIG. 2(*c*) shows crenulated square rib 6 having dimensions H that approximate those of square rib 3 shown in FIG. 1(*c*), and crenulations 40, 41 and 42 disposed longitudinally, that is, parallel to the long axis (not shown) of crenulated rib 6. Crenulations 40, 41 and 42 can be of any dimension so long as the strength of the crenulated ribs is not adversely affected.

Figure 3:
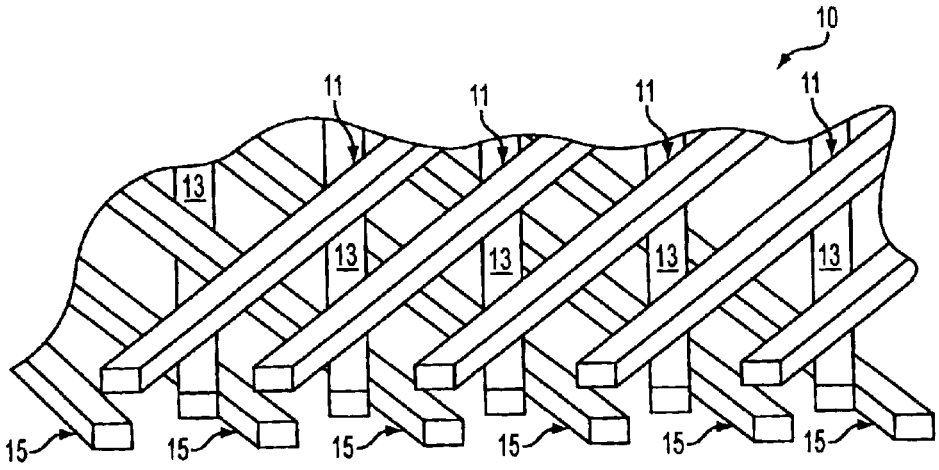
FIG. 3 shows an embodiment of a core element of the invention having three sets of rectangular ribs disposed in adjacent planes.

FIG. 3 shows an embodiment of a core element of the invention having three sets of parallel rectangular ribs disposed in adjacent planes. With reference to FIG. 3, triplanar ribbed core element 10 has parallel rectangular ribs 11 disposed in a first plane, parallel rectangular ribs 13 disposed in a second plane that is adjacent to the first plane, and parallel rectangular ribs 15 that are disposed in a third plane that is adjacent to the second plane. Preferably, core element 10 is formed in such a manner, for example by the concurrent extrusion of ribs 11, 13 and 15, that the ribs are connected to one another at their respective contact surfaces such that their positions relative to one another are fixed and stable. The three sets of parallel ribs are disposed non-parallel to one another to form core element 10. Thus, ribs 11 intersect with ribs 13 at a relative angle of from 30 to 90 degrees. Similarly, ribs 13 intersect with ribs 15 at a relative angle of from 30 to 90 degrees. With this range of intersectional angles, ribs 11 and 15 may be disposed anywhere from 60 degrees to 90 degrees relative to one another. In use, flow channels between ribs 11, 13 and 15, such as preferential flow channels, are formed as core element 10 and fluid-transmissible layers adjacent ribs 11 and 15 are compressed under the load of pavement and related support layers of a highway, for example. In general, the preferential flow channels are those that are disposed between the bottom layer, that is, ribs 15.

Figure 4:
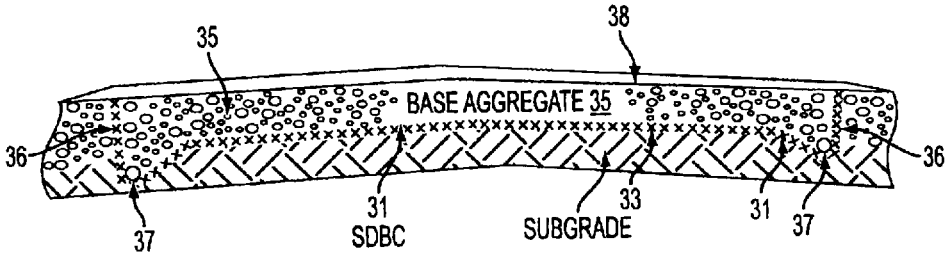
FIG. 4 shows the relative position within a paved road structure of an SDBC according to the invention.

FIG. 4 shows the relative position within a paved road structure of an SDBC according to the invention. With reference to FIG. 4, SDBC 31 is shown above natural soil subgrade layer 33 and below base aggregate support layer 35, which supports cementitious pavement layer 38. Drainpipes 37 are shown in contact with SDBC 31 and below both sloped layer 31 of the SDBC, and vertical portions 36 of the SDBC.

Figure 5A:
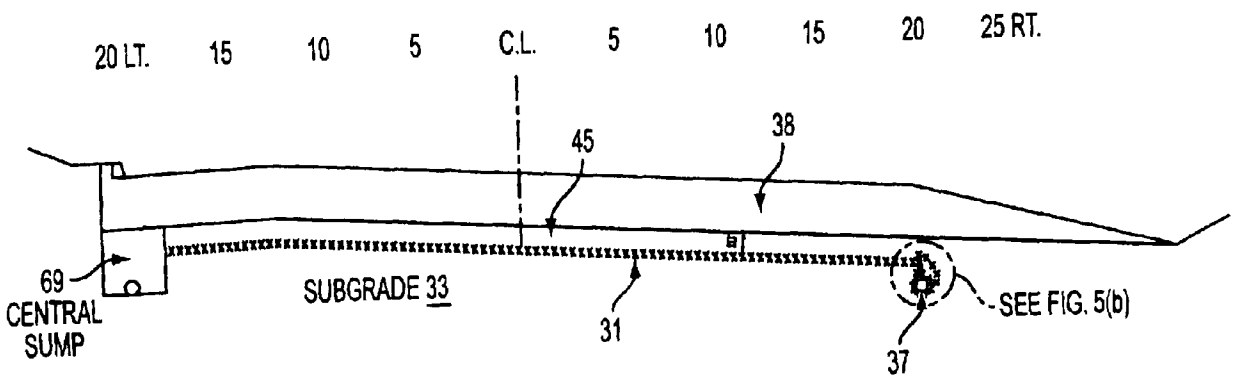
FIG. 5(*a*) shows another installation of an SDBC and its fluid communication with central and marginal drainpipes.
Figure 5B:
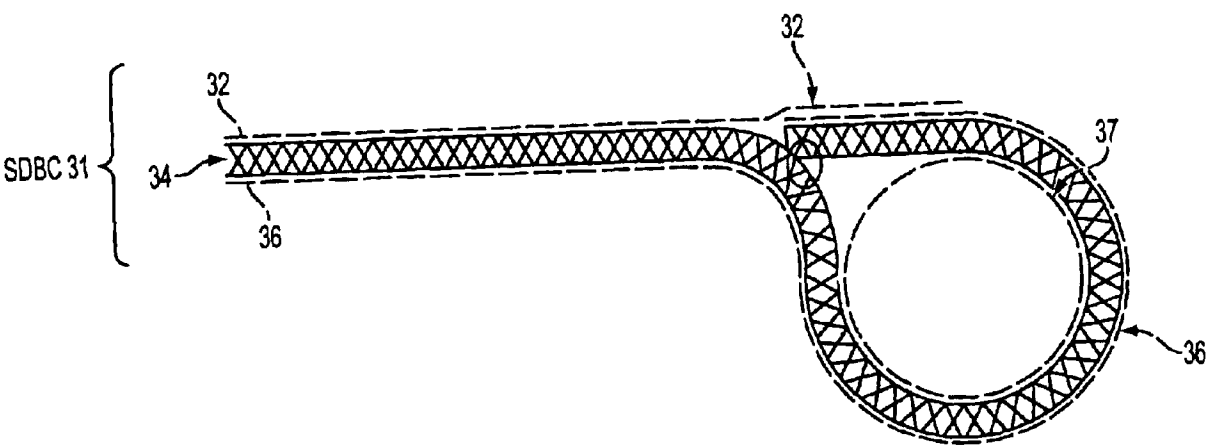

FIG. 5(*a*) shows another installation of an SDBC and its fluid communication with central sump 69 and marginal drainpipes 37. With reference to FIG. 5(*a*), SDBC 31 is shown above natural soil subgrade layer 33 and below thin base aggregate support layer 45, which supports cementitious pavement layer 38. Drainpipes 37 are shown in contact with SDBC 31 and below both sloped layer 31 of the SDBC.

FIG. 5(*b*) shows a detail of the installation of FIG. 5(*a*) where portions of the fluid-transmissible geotextile layers of the SDBC are wrapped around drainpipe 37. With reference to FIG. 5(*b*), SDBC 31 includes geonet core 34, upper fluid-transmissible geotextile layer 32 and lower fluid-transmissible geotextile layer 36. Portions of layer 32 are shown removed such that perforated drainpipe 37 is in fluid communication with geonet core 34.

What is claimed is:

1. A synthetic drainable base course for draining fluids away from a roadway or other large structure, comprising:

A) a void-maintaining geocomposite comprising i) a geocomposite core element having a plurality of ribs constructed and arranged to form a plurality of interconnected voids, said core element having an upper surface and a lower surface, a no-load thickness and a thickness under load, wherein said thicknesses are measured substantially perpendicular to said surfaces, ii) at least one fluid-transmissible layer adjacent said upper surface, and iii) at least one fluid-transmissible layer adjacent said lower surface of said geocomposite, wherein said layers and said core are constructed and arranged so that, under a load of at least 750 lbs/foot for a period of at least 100 hours, said geocomposite maintains voids of sufficient dimension that fluid from said roadway or other large structure can move freely through said geocomposite at rate of at least 1,000 feet$^3$/day/foot, and wherein said geocomposite is sloped downwardly in a gradient from a portion of said roadway or other large structure.

2. The synthetic drainable base course of claim 1, wherein said layers and said core are constructed and arranged so that, under a load of at least 1,000 lbs/foot$^2$ for a period of at least 100 hours, said void-maintaining geocomposite maintains voids of sufficient dimension that fluid from said roadway or other large structure can move freely through said geocomposite at rate of at least 2,000 feet$^3$/day/foot.

3. The synthetic drainable base course of claim 1, wherein said ribs of said core are provided in a first set and a second set, and a) said ribs of said first set are disposed substantially parallel to one another and substantially in a first plane, and 2) said ribs of said second set being disposed substantially parallel to one another and substantially in a second plane, and wherein said first and second planes are disposed adjacent one another.

4. The synthetic drainable base course of claim 3, wherein further ribs are provided in at least a third set wherein said ribs of said third set are disposed substantially parallel to one another and said third set of ribs is disposed in a third plane adjacent and non-parallel to the ribs of said first or second sets.

5. The synthetic drainable base course of claim 1, wherein the cross-section of any one of said ribs approximates one or more shapes from the group consisting of a square, a rectangle and a trapezoid.

6. The synthetic drainable base course of claim 5, wherein said square has a width and a height approximately equal to one another, and said width and height have dimensions of from 1.0 to 10.0 mm.

7. The synthetic drainable base course of claim 5, wherein said rectangle has a width and a height, and said width has dimensions of from 2.0 to 15.0 mm and said height has dimensions of from 1.0 to 10.0 mm.

8. The synthetic drainable base course of claim 5, wherein said trapezoid has a major width, a minor width and a height, and said major width has dimensions of from 2.0 to 15.0 mm, said minor width has dimensions of from 1.0 to 10.0 mm and said height has dimensions of from 1.0 to 10.0 mm.

9. The synthetic drainable base course of claim 1, wherein at least some of said ribs comprise crenulations and said crenulations are disposed longitudinally along the surfaces of said ribs.

10. The synthetic drainable base course of claim 1, wherein all of said ribs are crenulated and said crenulations are disposed longitudinally along the surfaces of said ribs.

11. The synthetic drainable base course of claim 1, wherein under a load of 1,200 kPa for at least 10,000 hours, said thickness under load is at least 65% of said no-load thickness.

12. The synthetic drainable base course of claim 1, wherein under a load of 1,200 kPa for at least 10,000 hours, said thickness under load is at least 60% of said no-load thickness.

13. The synthetic drainable base course of claim 1, wherein under a load of 1,200 kPa for at least 10,000 hours, said thickness under load is at least 50% of said no-load thickness.

14. The synthetic drainable base course of claim 1, wherein said no-load thickness is in the range of from 0.20 inches to 1.00 inches.

15. The synthetic drainable base course of claim 1, wherein said no-load thickness is in the range of from 0.20 inches to 0.75 inches.

16. The synthetic drainable base course of claim 1, wherein said no-load thickness is in the range of from 0.25 inches to 0.35 inches.

17. The synthetic drainable base course of claim 1, wherein said core element has a tensile strength of at least 400 lbs per square foot in both machine direction and cross-machine direction.

18. The synthetic drainable base course of claim 1, wherein said core element has a tensile strength of at least 500 lbs per square foot in both machine direction and cross-machine direction.

19. The synthetic drainable base course of claim 1, wherein under a load of 721 kPa for at least 100 hours, said thickness under load is at least 65% of said no-load thickness.

20. The synthetic drainable base course of claim 1, wherein under a load of 721 kPa for at least 100 hours, said thickness under load is at least 60% of said no-load thickness.

21. The synthetic drainable base course of claim 1, wherein under a load of 721 kPa for at least 100 hours, said thickness under load is at least 55% of said no-load thickness.

22. The synthetic drainable base course of claim 1, wherein under a load of 721 kPa for at least 100 hours, said thickness under load is at least 50% of said no-load thickness.

23. The synthetic drainable base course of claim 1, wherein said gradient is at least 2% in a direction away from said portion of said roadway.

24. The synthetic drainable base course of claim 1, wherein said portion of said roadway is the centerline.

25. The synthetic drainable base course of claim 1, wherein under a load of 721 kPa for at least 100 hours, said voids maintain an average width of at least 2.0 mm and an average height of at least 10.0 mm.

26. The synthetic drainable base course of claim 1, wherein under a load of 721 kPa for at least 100 hours, said voids maintain an average width of from 2.0 mm to 10.0 mm.

27. The synthetic drainable base course of claim 1, wherein under a load of 721 kPa for at least 100 hours, said voids maintain an average width of from 3.0 mm to 8.0 mm.

28. The synthetic drainable base course of claim 1, wherein under a load of 1,200 kPa for at least 100 hours, said voids maintain an average width of from 2.0 mm to 10.0 mm.

29. The synthetic drainable base course of claim 1, wherein under a load of 1,200 kPa for at least 100 hours, said voids maintain an average width of from 3.0 mm to 8.0 mm.

30. The synthetic drainable base course of claim 1, wherein under a load of 1,200 kPa for at least 100 hours, said voids maintain an average height of from 2.0 mm to 10.0 mm.

31. The synthetic drainable base course of claim 1, wherein under a load of 1,200 kPa for at least 100 hours, said voids maintain an average height of from 3.0 mm to 8.0 mm.

32. The synthetic drainable base course of claim 1, wherein under a load of 721 kPa for at least 100 hours, said voids maintain an average width of at least 3.0 mm and an average height of at least 10.0 mm.

33. The synthetic drainable base course of claim 1, wherein under a load of 1,200 kPa for at least 100 hours, said voids maintain an average width of at least 2.0 mm and an average height of at least 8.0 mm.

34. The synthetic drainable base course of claim 1, wherein under a load of 721 kPa for at least 100 hours, said voids maintain an average width of at least 6.0 mm and an average height of at least 8.0 mm.

35. The synthetic drainable base course of claim 1, wherein under a load of 1,200 kPa for at least 1,000 hours, said voids maintain an average width of at least 2.0 mm and an average height of at least 8.0 mm.

36. The synthetic drainable base course of claim 1, wherein under a load of 721 kPa for at least 1,000 hours, said voids maintain an average width of at least 6.0 mm and an average height of at least 8.0 mm.

37. The synthetic drainable base course of claim 1, wherein said ribs are constructed and arranged to form preferential flow paths and non-preferential flow paths.

38. The synthetic drainable base course of claim 37, wherein said preferential flow paths and said non-preferential flow paths are not parallel to one another and are formed by said ribs.

39. The synthetic drainable base course of claim 37, disposed in a roadway or other large structure such that said preferential flow path is substantially perpendicular to said portion.

40. The synthetic drainable base course of claim 37, wherein at least 65% of the volume of fluid moving through said SDBC does so by way of said preferential flow path.

41. The synthetic drainable base course of claim 39, wherein said portion of said roadway is the centerline.

42. The synthetic drainable base course of claim 1, wherein said geocomposite core comprises at least one margin constructed and arranged to transmit fluids from said base course away from said roadway or other large structure.

43. The synthetic drainable base course of claim 42, wherein said at least one margin is constructed and arranged to connect with one or more selected from the group consisting of perforated pipes, non-perforated pipes, drainage ditches, sumps, canals, streams and rivers.

44. The synthetic drainable base course of claim 42, wherein said drain means comprises perforated piping adjacent said synthetic drainable base course and communicating therewith such that said fluid can move from said base course to said perforated piping, wherein said perforated piping is sloped downwardly from said base course, wherein said base course is constructed and arranged to form a wrapping adjacent to and around the circumference of at least a portion of said perforated piping such that a portion of one of said upper or lower fluid-transmissible geotextile layers is removed along the length of the wrapping so that said geocomposite core contacts said piping and said removed portion of said one of said upper or lower fluid-transmissible geotextile layers comprises overlapping portions and is connected to the other surface fluid-transmissible geotextile layer.

45. A layered paved structure comprising

I. a base layer formed at least partially of native soil components,

II. a synthetic drainable base course disposed above said base layer and comprising A) a void-maintaining geocomposite including i) a geocomposite core element having a plurality of ribs constructed and arranged to form a plurality of interconnected voids, said core element having an upper surface and a lower surface, a no-load thickness and a thickness under load, wherein said thicknesses are measured substantially perpendicular to said surfaces, ii) at least one fluid-transmissible layer attached adjacent said upper surface, and iii) at least one fluid-transmissible layer attached adjacent said lower surface of said geocomposite, wherein said layers and said core are constructed and arranged so that, under a load of at least 750 lbs/foot$^2$ for a period of at least 100 hours, said geocomposite maintains voids of sufficient dimension that fluid from said roadway or other large structure can move freely through said geocomposite at rate of at least 1,000 feet$^3$/day/foot, and III. above said synthetic drainable base course, pavement comprising one or more layers of asphalt or cementitious materials, wherein said synthetic drainable base course is sloped downwardly in a gradient from a portion of said roadway or other large structure.

46. The layered paved structure of claim 45, further comprising a support layer, said support layer being disposed above said synthetic drainable base course, and below said pavement.

47. The layered paved structure of claim 46, wherein said support layer comprises one or more from the group consisting of native soil components, and non-native soil components.

48. A method of forming a layered paved structure having no open graded base course, comprising the steps of I. providing a base layer formed at least partially of native soil components, II. providing a synthetic drainable base course disposed above said base layer and comprising A) a void-maintaining geocomposite including i) a geocomposite core element having a plurality of ribs constructed and arranged to form a plurality of interconnected voids, said core element having an upper surface and a lower surface, a no-load thickness and a thickness under load, wherein said thicknesses are measured substantially perpendicular to said surfaces, ii) at least one fluid-transmissible layer attached adjacent said upper surface, and iii) at least one fluid-transmissible layer attached adjacent said lower surface of said geocomposite, wherein said layers and said core are constructed and arranged so that, under a load of at least 750 lbs/foot$^2$ for a period of at least 100 hours, said geocomposite maintains voids of sufficient dimension that fluid from said roadway or other large structure can move freely through said geocomposite at rate of at least 1,000 feet$^3$/day/foot, and III. above said synthetic drainable base course, providing pavement comprising one or more layers of asphalt or cementitious materials, wherein said synthetic drainable base course is sloped downwardly in a gradient from a portion of said roadway or other large structure.

49. The method of claim 48, further comprising the step of

IV. providing a support layer, said support layer being disposed above said synthetic drainable base course, and below said pavement, wherein said support layer comprises one or more from the group consisting of native soil components, and non-native soil components.

50. The method of claim 48, wherein said layers and said core are constructed and arranged so that, under a load of at least 1,000 lbs/foot$^2$ for a period of at least 100 hours, said void-maintaining geocomposite maintains voids of sufficient dimension that fluid from said roadway or other large structure can move freely through said geocomposite at rate of at least 2,000 feet$^3$/day/foot.

* * * * *